US006357462B1

(12) United States Patent
Laosunthara et al.

(10) Patent No.: US 6,357,462 B1
(45) Date of Patent: Mar. 19, 2002

(54) PORTABLE PLAYPEN

(75) Inventors: Janejira Laosunthara; Darani Laosonthorn, both of Bangkok (TH)

(73) Assignee: Battat, Inc., New York, NY (US)

( * ) Notice: Subject to any disclaimer, the term of this patent is extended or adjusted under 35 U.S.C. 154(b) by 0 days.

(21) Appl. No.: 09/505,613

(22) Filed: Feb. 17, 2000

(51) Int. Cl.[7] ..... A47D 7/00; A47C 29/00

(52) U.S. Cl. ..... 135/96; 135/126; 135/137; 135/138; 135/143; 135/115; 135/116; 5/99.1

(58) Field of Search ..... 135/96, 124, 125, 135/126, 128, 136, 137, 138, 143, 115, 116, 906, 913; 256/25; 5/99.1, 98.1, 97; 52/70, 71

(56) References Cited

U.S. PATENT DOCUMENTS 1,930,404 A * 10/1933 Wagner
2,253,024 A * 8/1941 Farrand
2,357,056 A * 8/1944 Nelson
2,429,350 A * 10/1947 Farrand
2,464,866 A * 3/1949 Holtz
3,498,587 A * 3/1970 Friedberg ..... 52/70
3,709,237 A * 1/1973 Smith ..... 135/115 X
3,777,321 A * 12/1973 Hargett ..... 5/99.1
4,003,098 A * 1/1977 Fink ..... 5/98.1
4,073,017 A * 2/1978 Stevens ..... 5/97
4,467,572 A * 8/1984 Somers et al. ..... 52/70
4,491,141 A * 1/1985 Eppenbach ..... 135/125
4,599,754 A * 7/1986 Mairs et al. ..... 135/96 X
5,379,786 A * 1/1995 Lynam ..... 135/87
D359,869 S 7/1995 Oren
5,441,069 A * 8/1995 Moss ..... 135/124
5,778,915 A * 7/1998 Zheng ..... 135/126
5,930,854 A * 8/1999 O'Neill et al. ..... 5/655
6,119,288 A * 9/2000 Hendrickson ..... 5/97
6,178,978 B1 * 1/2001 Rieber ..... 135/96

* cited by examiner

*Primary Examiner*—Robert Canfield
(74) *Attorney, Agent, or Firm*—Levisohn, Lerner, Berger & Langsam

(57) ABSTRACT

A portable playpen/mattress for babies is described. The playpen includes a flexible base and a plurality of substantially open walls all consecutively attached to each other. The walls are attachable to the base substantially perpendicular to the base. When the walls are attached to the base, the playpen is in an erected configuration, and when the walls are detached and folded one on top of another, the playpen is a collapsed configuration. The base is attachable to the walls in two configurations. When the corners of the base are curled around the leg portions of the walls, the base is in a rimmed configuration, and when the leg portions are directly attached to an upper surface of the base, the base is in a flat configuration. A reversible roof is selectively attachable to the walls. An outer cover is adapted to enclose the base and the walls in the erected configuration.

33 Claims, 5 Drawing Sheets

PORTABLE PLAYPEN

BACKGROUND OF THE INVENTION

1. Field of the Invention

The invention relates to playpens and mattresses for infants and young children, and more specifically to playpens and mattresses that may be easily collapsed, transported, and erected in a different location.

2. Description of the Related Art

Playpens, enclosed structures in which a baby can be safely left alone to play, have been in use for decades. Traditional playpens include a square base and square walls, the base having a soft cushion for the baby's comfort and the walls typically designed to keep the child inside. Although safe, traditional playpens do not look to be very appealing places to leave infants by themselves, owing to their cube-like shapes and sparse appearance. Playpens are only as much fun as the toys parents put in them. However, infants tend to throw toys out of the playpen and then vociferously complain (e.g., scream, cry, etc.) that they have no toys in the playpen. Parents must retrieve the toys and replace them in the playpen. This process is frequently repeated, often to the dismay and irritation of the parents.

Also, traditional playpens have been difficult to erect and collapse, thereby limiting their portability. Further, traditional playpens have been limited primarily for indoor use, owing to the possibility of ground moisture seeping into the bottom of the playpen or from rain or other precipitation falling on the infant from above.

U.S. Pat. No. Design 359,869 to Oren depicts a portable, collapsible baby mattress having a fabric base and two curved supports extending from opposite corners of the mattress and crossing above the center of the mattress. Toys may be attached to the curved supports so that the baby may play with them without throwing them away and forcing his/her parents to retrieve them. The Oren mattress is also easily collapsed and is very portable.

The Oren mattress suffers from a number of the deficiencies of traditional playpens. First, the Oren mattress is completely open above and on the sides to precipitation and insects. Second, Oren does not teach any enclosure to prevent or deter a baby placed thereon from simply crawling away. Third, the Oren device cannot be practically used outside because ground moisture will readily seep through the mattress and leave a soggy play area for the baby. Also, as with conventional playpens, the Oren device does not shield the baby from dangerous exposure to sunlight.

SUMMARY OF THE INVENTION

Accordingly, it is an object of the invention to provide a playpen for a baby that is easily collapsible and portable.

It is another object of the invention to provide a playpen for a baby that is usable in both indoor and outdoor settings.

It is another object of the invention to provide an attractive baby mattress that deters babies from crawling away and at the same time prevents toys from rolling away and insects from coming near the child.

It is another object of the invention to provide a playpen or mattress for a baby that prevents babies from hurling toys out of the playpen.

It is another object of the invention to provide a playpen for a baby that will protect the baby from exposure to the sun.

It is another object of the invention to provide a playpen or mattress for a baby that will protect the baby from precipitation and insects in an outdoor setting.

The above and other objects are achieved by the invention, which is a portable playpen/mattress for newborns, infants and young children. The invention includes a flexible padded base and a plurality of substantially open walls all preferably consecutively attached to each other. The walls are attachable to the base substantially perpendicular to the base. When the walls are attached to the base, the playpen is in an erected configuration, and when the walls are detached from the base and folded one on top of another, the playpen is a collapsed and thus easily transported configuration. The base is attachable to the walls in two configurations. When the corners of the base are curled around the leg portions of the walls, the base is in an upturned or rimmed configuration, and when the leg portions are directly attached to an upper surface of the base, the base is in a planar or flat configuration. A reversible roof is selectively attachable to the walls. The roof will shield the baby from direct sunlight. Toys may be attached to or suspended from fabric sheet portions of the walls and/or hooks on the roof so as to prevent the baby from throwing them out of the playpen. All of the components which may be selectively attached and detached may be done so by any conventional attaching means, such as micro-hook fasteners (e.g., VELCRO), a zipper, a tie, laces, a snap, a buckle, a magnet, adhesive, and/or a hook. The walls are substantially open, arc-shaped flexible rods covered with fabric to form an open archway. In the preferred embodiment, four walls are secured together to form a dome-like structure by attaching one leg of a wall element to a leg of an adjacent wall element. In the preferred embodiment, all four walls may have their legs permanently sewn together. Nevertheless, the structure can be folded with one wall on top of another wall so that the collapsed configuration is four stacked wall sections.

An outer cover is adapted to enclose the base and the walls in the erected configuration. The outer cover preferably includes an upper water-resistant roof portion positionable over the roof of the playpen. This upper portion prevents rain or other precipitation from striking the baby and wetting the base. The outer cover may also preferably include a central porous or mesh portion positionable in front of the walls, or at least in front of the open portions of the walls. The mesh allows air to circulate through the interior of the playpen but keeps insects out of the interior and away from the baby. The outer cover may also preferably include a lower water-resistant base portion positionable below the base adapted to keep ground moisture from seeping up and into the base. A zipper may be provided as an easy mechanism to open and close the cover, as desired. In an alternate embodiment, small fabric loops can be suspended from the center of the fabric covering the wall sections to provide support for toys, e.g., hand manipulatives and/or mobile articles. In an alternate embodiment, C or O-shaped connector elements interconnect between the fabric loops, just mentioned, and the hand manipulatives and/or mobile articles. These connector elements can, in an alternate embodiment, be teething rings, pacifiers and/or rattles.

DETAILED DESCRIPTION OF THE PREFERRED EMBODIMENTS AND THE DRAWINGS

A description of the invention will now be given with reference to FIGS. 1–9. These figures should be considered merely exemplary and in no way limit the scope of the invention.

Figure 1:
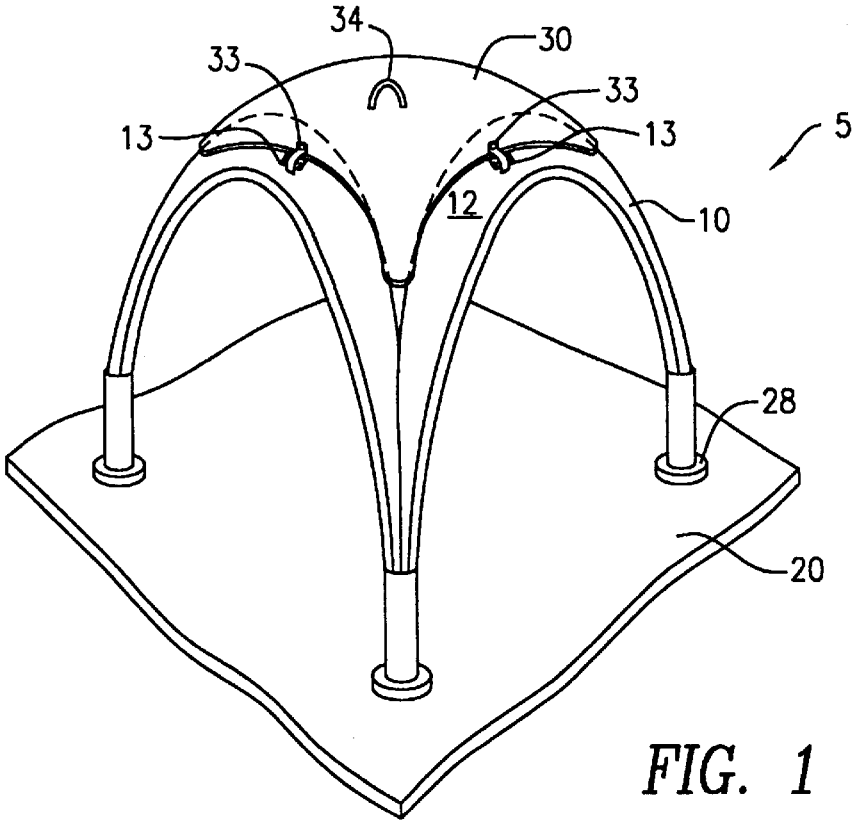
FIG. 1 is a perspective view of an assembled portable playpen according to the invention with the base in a flat configuration.
Figure 2:
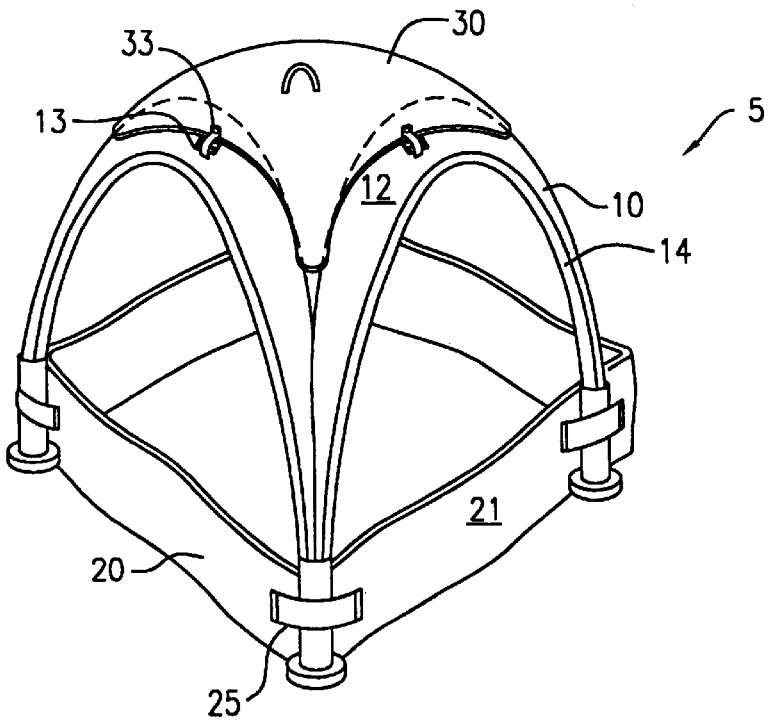
FIG. 2 is a perspective view of an assembled portable playpen according to the invention with the base in a rimmed configuration.

The inventive playpen 5 is shown in FIGS. 1 and 2 in two slightly different erected configurations. Like parts are shown with like reference numerals. Playpen 5 includes a plurality of walls 10. In the preferred embodiment, four walls 10 are provided, however any number of walls greater than two is contemplated as within the scope of the invention. Because the invention is intended to be easily collapsible and portable, three or four walls 10 are believed optimal. Generally, walls 10 are selectively attached to base 20, and roof 30 is selectively attached to the tops of walls 10.

Figure 4:
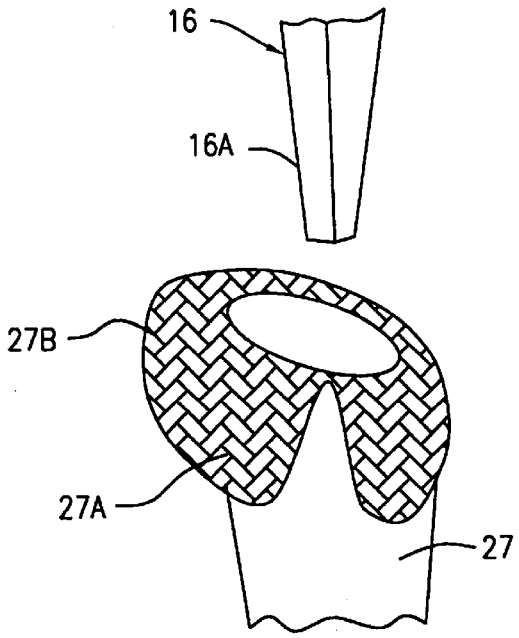
FIG. 4 is a perspective, slightly exploded view of the walls of a portable playpen according to the invention as it is being assembled.
Figure 9:
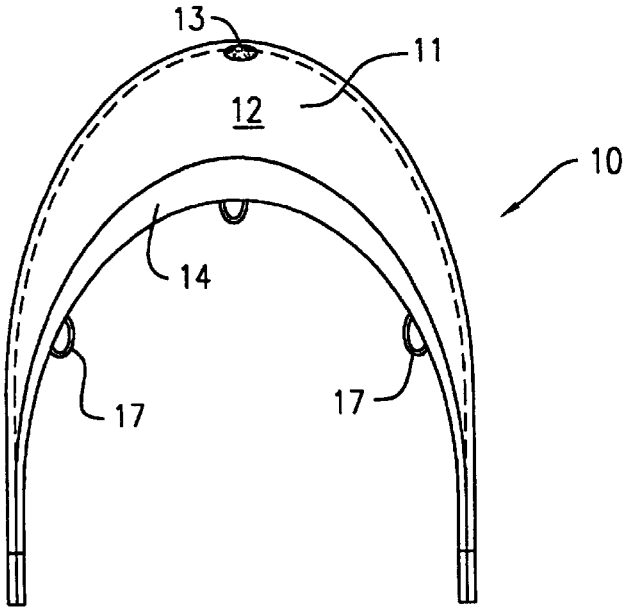
FIG. 9 is a side elevational view of one wall of the inventive playpen.

FIG. 9 is a schematic of one of the walls 10 of playpen 5. Preferably, wall 10 includes an arch-shaped support bar 11 which provides structural support for the wall. Support bar 11 is preferably tubular and made of plastic or other similar lightweight material. Fabric sheet 12 is formed with a seam to create a tubular pocket which surrounds support bar 11. The fabric sheet essentially makes up the flat "wall" portion of wall 10. As shown in FIG. 4, fabric sheet 12 is preferably provided with one printed pattern on one side (e.g., dots) and a different printed pattern on the other side (e.g., stripes), for reasons which will be made clear below. On the upper rim of wall 10 an attachment 13 is provided for securing the roof (discussed below) onto the playpen 5. The ends of support bar 11 terminate in leg portions 16 of wall 10. Between leg portions 16 and beneath fabric sheeting 12 lies an open space A, which enables a child to look outside of the playpen as well as enter and egress. Since each wall is provided with an open space A, the playpen 5, when erected, has an open, airy structure like a small gazebo.

At a lower portion of fabric sheeting 12, a band 14 of Velcro-attachable fabric (i.e., the micro-loop portion) is provided. Small toys (not shown), such as stuffed animals, rattles, squeak toys, etc. may be affixed via the corresponding hook Velcro component to band 14. These toys will thus dangle within reach of the child; the child will be able to see and play with the toys, however the child will not be able to throw the toys away from the playpen. Similarly, loops 17 are also (or alternatively) provided for attaching toys. Other types of fastening devices such as a zipper, a tie, a snap, a buckle, a magnet, and a hook may also be provided for the purpose of attaching or affixing toys to the bottom portion of arch-shaped walls 10.

Figure 3:
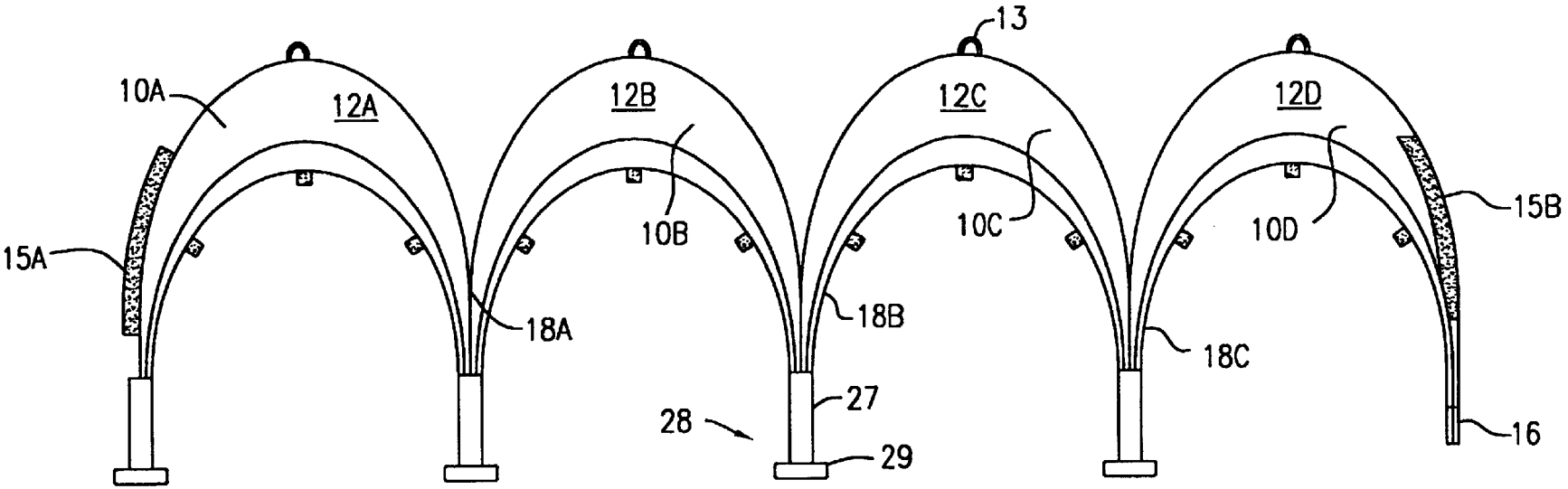
FIG. 3 is a side elevation view of the walls of a portable playpen according to the invention in the dissembled configuration prior to the walls being folded for transport or prior to the walls being connected in assembly.

As shown in FIG. 3, the preferred embodiment of playpen 5 is provided with four walls 10A–D. Each wall 10 is substantially identical to the other three walls, although each wall may be provided with a different printed pattern than the other walls. The walls are preferably attached to each other at their fabric sheetings 12 at connection points or seams 18. As shown in FIG. 3, for example, sheet 12A is attached to sheet 12B at connection seam 18A, sheet 12B is attached to sheet 12C at connection seam 18B, and sheet 12C is attached to sheet 12D at connection seam 18C. Wall 10A is not necessarily permanently connected to wall 10D. Rather, wall 10A is provided with attachment flap 15A which is matingly engageable with attachment flap 15B disposed on wall 10D. Preferably, flaps 15A–B are made from corresponding hook and loop Velcro components, however any fastening structure, such as a zipper, a tie, a snap, a buckle, a magnet, a hook, or any other known conventional fastening mechanisms could be used in conjunction with or instead of attachment flaps 15A–B. When walls 10A and D are attached to one another via flaps 15A and B, the walls are erected and configured as shown in FIG. 4. The walls are substantially open, arc-shaped flexible rods covered with fabric to form an open archway. In the preferred embodiment, four walls are secured together to form a dome-like structure by attaching one leg of a wall element to a leg of an adjacent wall element. In the preferred embodiment, all four walls may have their legs permanently sewn together. Nevertheless, the structure can be folded with one wall on top of another wall so that the collapsed configuration is four stacked wall sections.

By consecutively attaching walls 10A–D while leaving one end of first wall 10A and the other end of last wall 10D free, the walls may be selectively erected with either side facing outwards. That is, the wall arrangement shown in FIGS. 3 and 4 are reversible. By providing a different pattern on one side of the walls than the other, the appearance of the playpen (when viewed from either the inside or the outside) can be significantly altered merely by reversing the walls.

Figure 5:
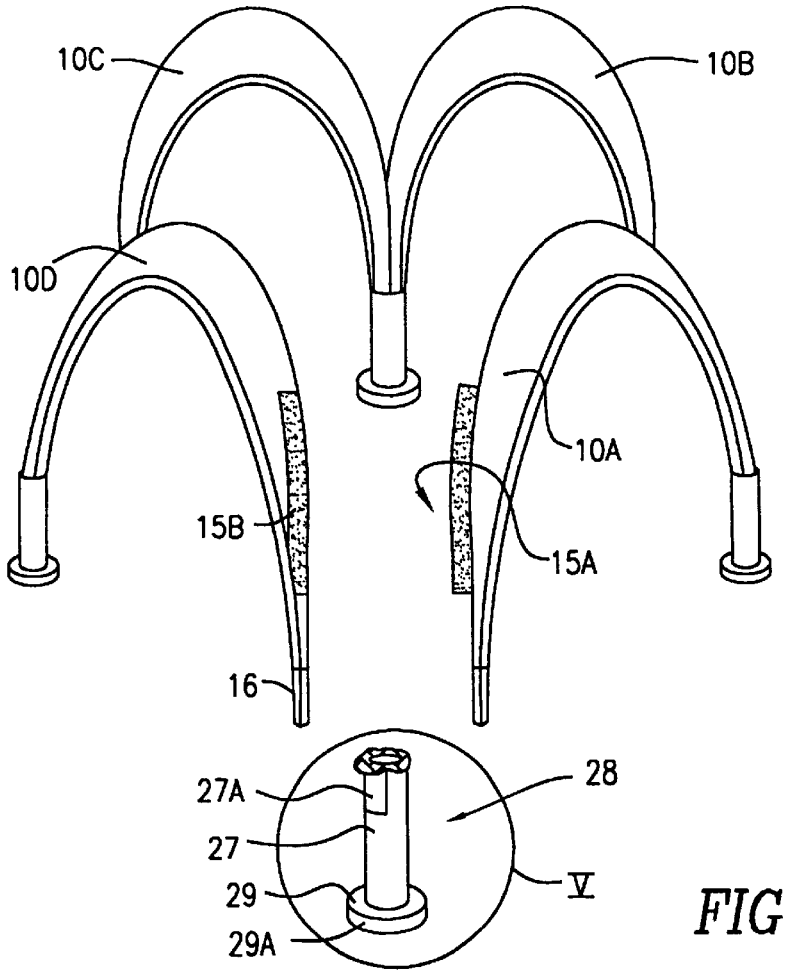
FIG. 5 is an enlarged, detailed view of portion V of FIG. 4 with the top rim of the foot everted.

The mechanism that connects the walls 10 to base 20 includes feet 28. As shown in FIG. 3–5, feet 28 have a roughly tubular pocket portion 27 affixed or sewn to a base portion 29. The upper rim of pocket portion 27 includes a flap 27A; one of Velcro hooks or loops 27B is preferably disposed in the interior of pocket portion 27B. Leg portions 16 of two adjacent walls 10 are placed into feet 28. Flap 27A facilitates the placement of leg portions 16 within pocket portion 27. The ends of the leg portions 16 are provided with the other Velcro component to complement Velcro hooks or loops 27B. Base portion 29 is provided with Velcro 29A (e.g., the hooks, see FIG. 4) or similar attachment structure for securing foot 28 to base 20 (which possesses the corresponding loops) when base 20 is in its flat configuration.

Roof 30 is attachable to the tops or upper rims of walls 10 to block sunlight from impinging directly on a child in the interior of the playpen. Roof 30 is provided with attachment stays 33 which matingly engage with attachments 13 disposed on the upper rims of walls 10 (see FIGS. 1 and 2). Preferably, stays 33 and attachments 13 are made with Velcro components, however zippers, ties, laces, snaps, buckles, magnets, adhesive, and/or hooks would also function adequately and fall within the scope of the invention. Roof 30 is also designed so that it may be attached to less than all of the upper rims of the walls 10 at the same time. That is, instead of attaching roof 30 to all four walls 10 as in FIGS. 1 and 2, roof 30 might only be selectively attached to one wall or two adjacent walls, thereby enabling the unattached part of roof 30 to be folded over the attached part. This configuration provides additional ventilation. Preferably, roof 30 is made of flexible fabric and has one pattern printed on one side and a different pattern printed on the other side. Loop 34 is preferably provided on at least one side of roof 30 and can be provided on both sides of roof 30. On the top side, loop 34 can function as a handle for parents to lift the playpen and move it without collapsing it. On the bottom side, loop 34 can be used to secure a toy or toys in the same fashion as loops 17.

As mentioned above, open spaces A in walls 10 allow a child (if the child is walking or crawling) to enter or exit the playpen. The inventive playpen 5 includes two child retention mechanisms. First, as shown in FIG. 2, base 20 is preferably provided with stays or straps 25 on the bottom of the base near the perimeter and/or corners of the base. These straps 25 are preferably made with velcro components but could also be any of a zipper, a tie, laces, a snap, a buckle, a magnet, adhesive, a hook, etc. Straps 25 wrap around pocket portions 27 of feet 28, causing the corners of base 20 to curl around leg portions 16. If all of the corners of the base 20 are so curled around all of the leg portions 16 of the walls 10, the entire perimeter of base 20 is curled upwards forming a rim 21 (see FIG. 2). Rim 21 will deter children who are beginning to crawl from leaving the interior of the playpen 5. Rim 21 should also deter crawling bugs and small animals from entering.

Figure 6:
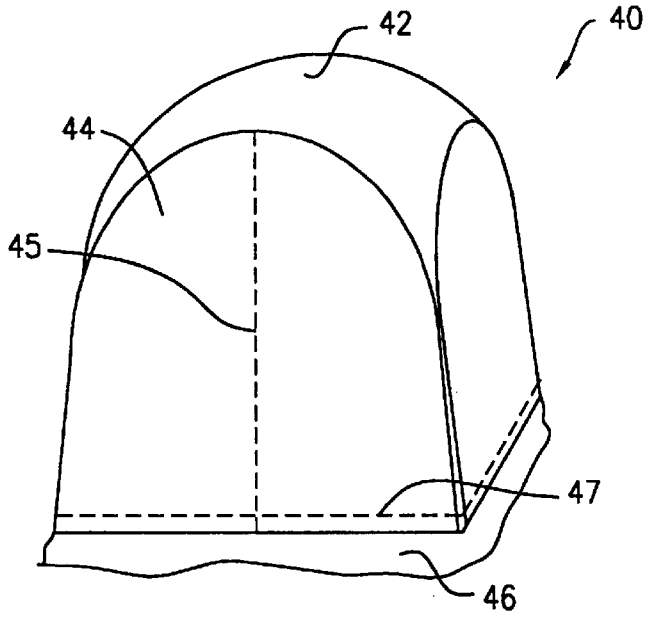
FIG. 6 is a perspective view of a cover for the playpen.
Figure 7:
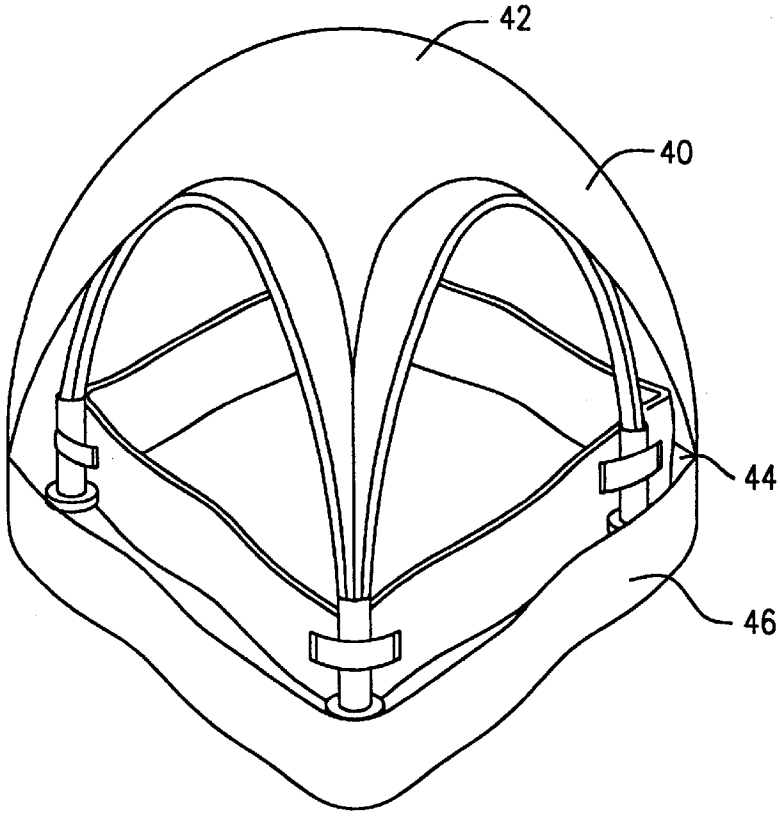
FIG. 7 is a perspective view of a cover for the playpen, covering the playpen.

A second child-retaining mechanism is shown in FIGS. 6 and 7 in the form of cover 40. Cover 40 is an outer covering which surrounds and encloses all or part of playpen 5 when the playpen is in one of its erected configurations. Cover 40 includes an upper roof portion 42, a central portion 44, and a lower base portion 46. Preferably, roof portion 42 sits atop roof 30 when cover 40 is disposed over playpen 5 and if roof 30 is attached. Roof portion 42 is preferably water-resistant or waterproof and prevents rain or other precipitation from making the interior of the playpen soggy. Without roof portion 42, rain would strike roof 30; since roof 30 is preferably made of fabric or padding, eventually the rain would soak through. The bottom corners of the side with zipper 45 may be provided with Velcro portions to allow that side to be folded back and maintained in an open position. The Velcro portions should adhere to the fabric of the walls or to Velcro components located there.

Central portion 44 is preferably made of a mosquito netting or a mesh material such as nylon. Central portion 44 covers walls 10 and specifically open spaces A of walls 10. Central portion 44 is adapted to allow air to flow through the playpen while keeping bugs away from the child. Central portion 44 also prevents the child from escaping the playpen. One pane of central portion 44 is preferably provided with a zipper 45 which separates to allow a parent to remove a child from the playpen without removing cover 40 from the playpen.

The bottom of cover 40 is provided with a preferably water-resistant or waterproof base portion 46. Base portion 46 is disposed between base 20 and the ground when cover 40 encloses playpen 5. Base portion 46 is preferably larger in surface area than base 20 and prevents ground moisture from seeping into base 20 and helps to keep the child dry within. Thus, with cover 40 disposed around playpen 5, a child inside will remain dry and protected from the elements. This feature is particularly advantageous for parents who like to go hiking, camping, or the like and who want to bring their newborns or toddlers along with them.

Figure 8:
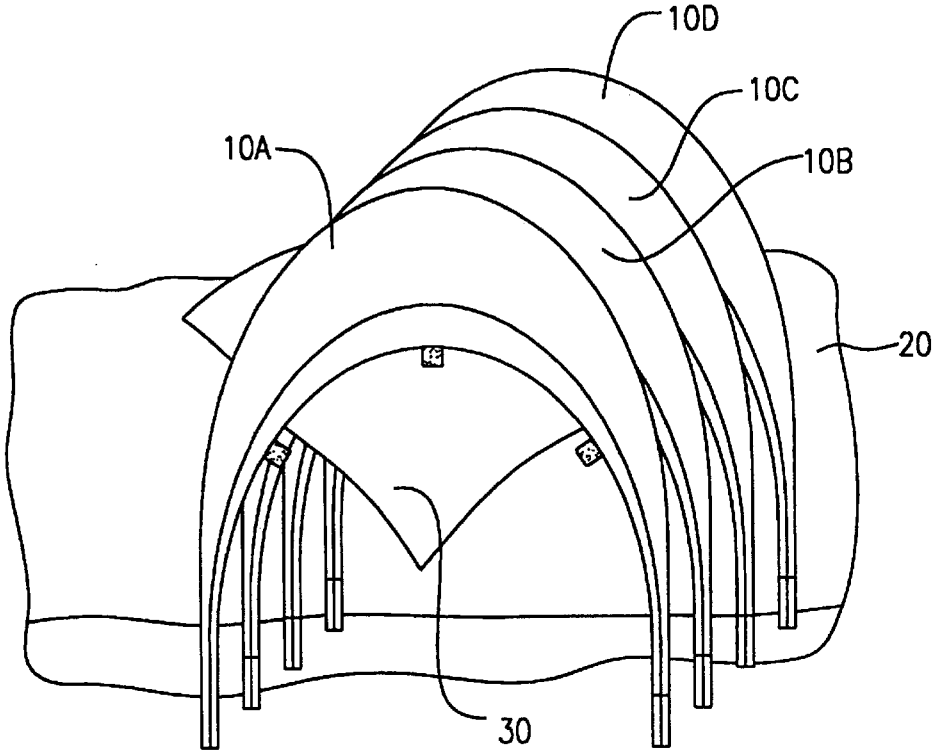
FIG. 8 is top view of the inventive playpen in a collapsed configuration.

The invention is further appealing to parents because of its collapsibility and portability. As shown in FIG. 8, when walls 10 are removed from base 20, they may be folded one on top of the other, owing to connection points 18 being made preferably of pliable fabric. Since base 20 can also be folded upon itself, and since roof 30 is a flat piece of padding, the entire playpen can be dissembled into a nearly flat package. Also, because the components are all lightweight, the collapsed invention is easy to pick up and move from place to place. In one embodiment, the entire device can be transported in a carrying case.

The assembly of the device is very simple and is described here. The parent wishing to erect the playpen removes it from its packaging and begins with the collapsed configuration shown in FIG. 8. Feet 28 preferably remain secured to leg portions 16; however, it is also possible that the assembler will have to place feet 28 onto leg portions 16. In either case, walls 10 are unfolded to face each other as shown in FIG. 4. Flaps 15A and 15B are made to engage each other to secure wall 10A to wall 10D. Walls 10 bearing feet 28 are placed on top of base 20. Owing to the Velcro component 29A (or other fixing structure) on the bottom of feet 28, walls 10 stick to base 20 and remain substantially perpendicular to the base. The assembler has several options at this point. Straps 25 may be secured around the bottom of leg portions 16 to create rim 21. Toys having Velcro strips or pads may be affixed to fabric portions 14 of walls 10 or by hooks onto loops 17. In an alternate embodiment, small fabric loops can be suspended from the center of the fabric covering the wall sections to provide support for toys, e.g., hand manipulatives and/or mobile articles. In an alternate embodiment, C or O-shaped connector elements interconnect between the fabric loops, just mentioned, and the hand manipulatives and/or mobile articles. These connector elements can, in an alternate embodiment, be teething rings, pacifiers and/or rattles. Roof 30 may be secured to the upper rims of walls 10. Finally, the entire playpen 5 may be placed inside cover 40. There are many options and configurations. After the child is placed inside, the parent may close zipper 45 to protect the child from insects. Breaking down the invention and collapsing it back to a form suitable for storage and transportation entails the same or similar steps listed here but in reverse and will not be discussed further.

The invention is not limited to the above description but rather is defined by the claims appearing hereinbelow. Modifications to the above description that include that which is known in the art are well within the scope of the contemplated invention. For example, the base is shown in the figures as being square, however a base of any shape (round, triangular, hexagonal, octagonal, heart-shaped, irregular, etc.) is contemplated as being within the scope of the invention.

What is claimed is:

1. A portable playpen for infants and young children, comprising:

a plurality of walls, each of said walls having a first end and a second end opposite said first end, each of said walls being connected to another of said walls on at least one of said first and second ends at connection points, each of said walls having leg portions at the bottoms of said walls; and a base, detachably connected to said leg portions of said walls, wherein said walls are foldable at said connection points into a collapsed, relatively flat configuration.

2. A portable playpen according to claim 1, wherein a first end of a first of said walls is detachably connected to a second end of a last of said walls.

3. A portable playpen according to claim 1, each of said walls comprising a support bar and fabric sheeting at least partially surrounding said support bar, wherein adjacent said walls are attached to each other at said connection points by their respective said fabric sheetings.

4. A portable playpen according to claim 3, wherein at least some of said fabric sheetings of adjacent said walls are sewn together.

5. A portable playpen according to claim 4, wherein a first end of a first of said walls is not sewn to a second end of a last of said walls, said first end of a first of said walls and said second end of said last end of said walls being selectively detachable by at least one of hook-and-loop fastening means, a zipper, a tie, laces, a snap, a buckle, a magnet, adhesive, and a hook.

6. A portable playpen according to claim 3, further comprising feet, each of said feet having a base pad and a pocket, wherein said leg portions of adjacent of said walls are removably fittable within said pockets, and wherein said base pad is detachably connectable to said base, said leg portions being removably fittable to said feet via at least one of hook-and-loop fastening means, a zipper, a tie, laces, a snap, a buckle, a magnet, adhesive, and a hook.

7. A portable playpen according to claim 3, wherein said support bar is arch-shaped and said fabric sheeting does not fully extend from one of said leg portions of said walls, each of said walls thereby forming an open arch structure, each of said walls having an upper rim.

8. A portable playpen according to claim 7, further comprising a detachable roof selectively attachable to said upper rims of said walls via at least one of hook-and-loop fastening means, a zipper, a tie, laces, a snap, a buckle, a magnet, adhesive, and a hook.

9. A portable playpen according to claim 8, wherein said roof is made of a flexible material and is foldable and selectively attachable to fewer than all of said upper rims of said walls at a given time.

10. A portable playpen according to claim 1, further comprising feet, each of said feet having a base pad and a pocket, wherein said leg portions of adjacent of said walls are removably fittable within the same said pockets, and wherein said base pad is detachably connectable to said base.

11. A portable playpen according to claim 10, wherein said base pads are detachably connectable to said base via at least one of hook-and-loop fastening means, a zipper, a tie, a snap, a buckle, a magnet, and a hook.

12. A portable playpen according to claim 10, wherein said leg portions are selectively connectable to said pockets via at least one of hook-and-loop fastening means, a zipper, a tie, a snap, a buckle, a magnet, and a hook.

13. A portable playpen according to claim 12, said walls each including fabric sheeting covering said leg portions, said pockets each including a flap for opening and closing a side of said pocket, said pocket having an interior into which said leg portions are selectively disposable.

14. A portable playpen according to claim 13, wherein said interior portions comprise at least one of hook-and-loop fastening means, a zipper, a tie, a snap, a buckle, a magnet, and a hook for securing said leg portions in said interiors of said pockets.

15. A portable playpen according to claim 13, wherein each of said pockets is adapted to receive two of said leg portions, one each from adjacent said walls.

16. A portable playpen according to claim 3, said walls each having a first flat side and a second flat side, wherein said fabric sheetings have a first pattern on said first flat side of said walls and a second pattern on said second flat side of said walls.

17. A portable playpen according to claim 8, wherein said roof is made of fabric, a first side of said roof having a first pattern and a second side of said roof having a second pattern.

18. A portable playpen according to claim 1, wherein said base is flexible and further comprises attaching means, disposed on a bottom surface of said base near a perimeter of said base, for selectively attaching said base to said leg portions of said walls by curling up corners of said base around said leg portions, thereby providing said base with a raised rim.

19. A portable playpen according to claim 18, wherein said attaching means includes at least one of hook-and-loop fastening means, a zipper, a tie, laces, a snap, a buckle, a magnet, adhesive, and a hook.

20. A portable playpen according to claim 1, further comprising a removable outer cover disposable around said playpen when said playpen is in an erected configuration that at least partially surrounds said playpen.

21. A portable playpen according to claim 20, wherein said outer cover totally surrounds and encloses said playpen.

22. A portable playpen according to claim 21, wherein said outer cover further comprises:

an upper, water-resistant roof portion, positionable above tops of said walls;

a central, porous portion positionable in front of said walls and adaptable to allow air to circulate through an interior of said playpen but adapted to keep insects out of said interior; and a lower, water-resistant base portion positionable below said base adapted to keep ground moisture from seeping into said base.

23. A portable playpen according to claim 20, wherein said outer cover is shaped to conform to an exterior of said playpen in said erected configuration.

24. A portable playpen according to claim 22, wherein said central porous portion includes an opening to allow entry or egress from said interior of said playpen when said outer cover is disposed around said playpen, said opening being selectively closable via at least one of hook-and-loop fastening means, a zipper, a tie, a snap, a buckle, a magnet, and a hook.

25. A portable playpen according to claim 3, said support bar and said fabric sheeting being arch-shaped, wherein toys may be selectively attached to said fabric sheeting via at least one of hook-and-loop fastening means, a zipper, a tie, a snap, a buckle, a magnet, and a hook.

26. A portable baby mattress, comprising:

a flexible base; and a plurality of walls consecutively attached to each other, a first of said walls being attachable to a last of said walls, said walls being attachable to said base substantially perpendicular to said base, wherein when said walls are attached to said base, said baby mattress is in an erected configuration, and when said walls are detached and folded one on top of another, said baby mattress is in a collapsed configuration, and wherein said base is attachable to said walls via a means selected from hook-and-loop fastening means, a zipper, a tie, laces, a snap, a buckle, a magnet, adhesive, and a hook.

27. A portable baby mattress according to claim 26, said walls having leg portions at the bottoms of said walls, said base further comprising attaching means, disposed on a bottom surface of said base near a perimeter of said base, for selectively attaching said base to said leg portions of said walls by curling up corners of said base around said leg portions, wherein when said corners of said base are curled around said leg portions, said base is in a rimmed configuration, and when said leg portions are directly attached to an upper surface of said base, said base is in a flat configuration.

28. A portable baby mattress according to claim 26, further comprising a roof selectively attachable to upper portions of said walls.

29. A portable baby mattress according to claim 28, wherein said roof is flexible and may be selectively attached to fewer than all of said walls.

30. A portable baby mattress according to claim 26, further comprising an outer protective cover adapted to enclose said base and said walls in said erected configuration.

31. A portable baby mattress according to claim 30, said outer cover comprising:

an upper roof portion, positionable above tops of said walls;

a central mesh portion, positionable in front of said walls; and a lower base portion, positionable below said base.

32. A portable baby mattress according to claim 31, wherein said roof and base portions of said outer cover are water-resistant.

33. A portable baby mattress according to claim 26, said walls further each comprising a support bar and fabric sheeting, said support bar and said fabric sheeting being arch-shaped, wherein dangling toys may be selectively attached to said fabric sheeting via at least one of hook-and-loop fastening means, a zipper, a tie, laces, a snap, a buckle, a magnet, adhesive, and a hook.

* * * * *